US010436537B2

(12) United States Patent
Fudala et al.

(10) Patent No.: US 10,436,537 B2
(45) Date of Patent: Oct. 8, 2019

(54) INTEGRATED RIFLE AND SPOTTING SCOPE MOUNT

(71) Applicant: Brian Willingham, Marion, KY (US)

(72) Inventors: Maciej Fudala, Homer Glen, IL (US); Dariusz Fudala, Homer Glen, IL (US)

( * ) Notice: Subject to any disclaimer, the term of this patent is extended or adjusted under 35 U.S.C. 154(b) by 0 days.

(21) Appl. No.: 15/786,588

(22) Filed: Oct. 17, 2017

(65) Prior Publication Data

US 2019/0113298 A1 Apr. 18, 2019

(51) Int. Cl.
*F41A 23/14* (2006.01)

(52) U.S. Cl.
CPC ..... *F41A 23/14* (2013.01)

(58) Field of Classification Search
CPC ..... F41A 23/00; F41A 23/06; F41A 23/10; F41A 23/14
USPC ..... 42/94; 89/37.04; 248/163.1
See application file for complete search history.

(56) References Cited

U.S. PATENT DOCUMENTS 3,225,656 A * 12/1965 Flaherty ..... F41A 23/06 42/94
3,986,285 A * 10/1976 Krisay ..... F41G 11/003 42/127
4,886,230 A * 12/1989 Jones ..... F16M 11/10 248/170
5,903,995 A * 5/1999 Brubach ..... F41A 23/06 42/90
6,272,785 B1 * 8/2001 Mika ..... F41A 23/14 42/94
7,543,524 B1 * 6/2009 Javorsky ..... F41A 9/60 42/94
8,123,427 B2 * 2/2012 Vogt ..... F16C 11/106 403/137
9,739,561 B1 * 8/2017 Hagedorn ..... F41A 27/18
2008/0072471 A1 * 3/2008 Keng ..... F41G 11/003 42/124
2010/0254697 A1 * 10/2010 Johnson ..... F16M 11/02 396/428
2010/0294120 A1 * 11/2010 Deckard ..... B64D 7/06 89/33.4
2012/0273631 A1 * 11/2012 Deros ..... F16M 11/041 248/122.1
2016/0360096 A1 * 12/2016 Holmes ..... G06T 7/80
2018/0058795 A1 * 3/2018 Scott ..... F41A 23/34

* cited by examiner

*Primary Examiner* — Bret Hayes
(74) *Attorney, Agent, or Firm* — James D Palmatier; Applied Patent Services, PC

(57) ABSTRACT

The integrated rifle and spotting scope mount is a frame for mounting on a support, the frame providing a rifle mount, a spotting scope mount. The rifle mount adjustably held in fixed relation, spaced from the spotting scope mount allowing synchronized movement of the rifle and spotting scope along a generally vertical plane and generally horizontal plane. The support may be a tripod having a spring loaded apex mechanism removably attaching a leveling ball mount to the tripod. The shot line of the rifle, the aim line of the rifle scope and the sight line of the spotting scope move together to track a moving target. An eye relief adjustment on the spotting scope adjusts the position of a spotting scope eye piece relative to the rifle scope.

17 Claims, 6 Drawing Sheets

FIG. 1
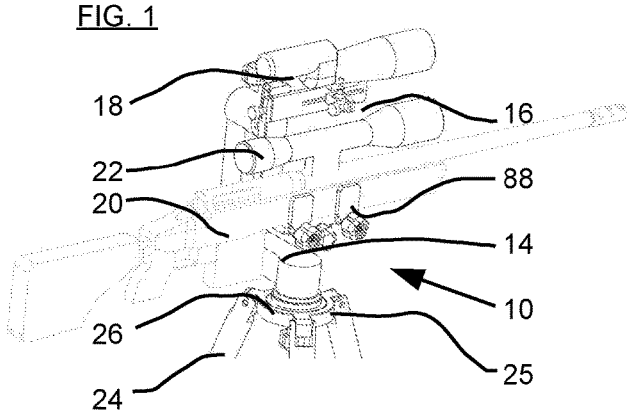
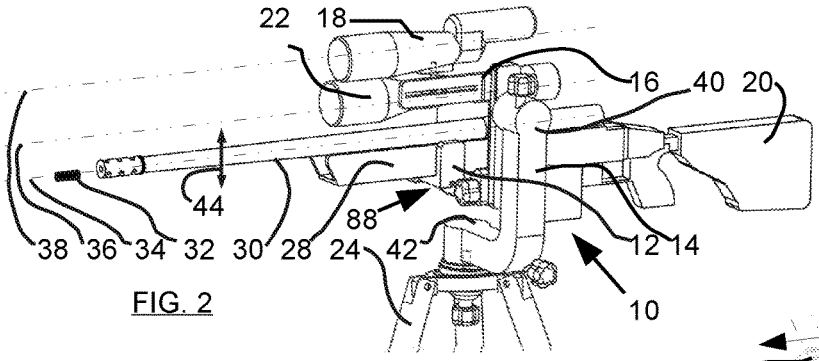
FIG. 2
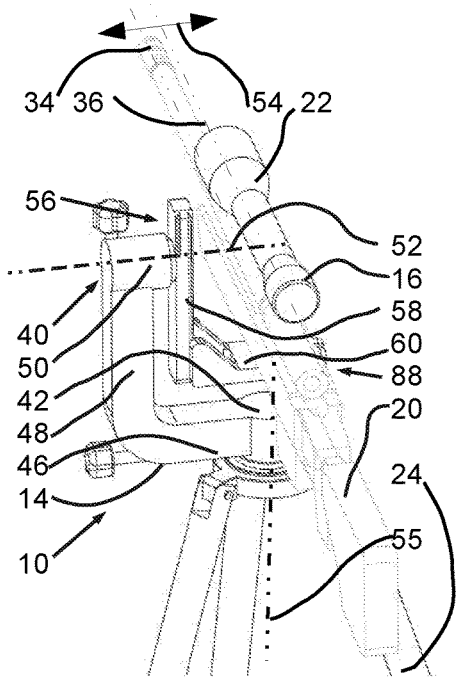
FIG. 3

INTEGRATED RIFLE AND SPOTTING SCOPE MOUNT

FIELD OF THE INVENTION

The present invention relates generally to support systems for a long gun used in long range shooting.

BACKGROUND OF THE INVENTION

The use of a long gun or rifle for shooting at long distances is usually helped by the use of a rifle support. A spotting scope is commonly used to verify targets and to provide feedback to the shooter for making adjustments to the aim. Rifle supports such as shooting rests, mono pods, tripods and bi-pods are known for use with rifles and other light arms for supporting a portion of the weight of the rifle and reducing unwanted movement. Resting the rifle on a support surface helps the shooter to improve aiming and reduce fatigue. The support is also used to support other aimed devices, such as spotting scopes and cameras.

Many prior art supports for rifles include relatively complicated mechanical pivot and adjustment mechanisms and are heavy and expensive to manufacture. A spotting scope used with the rifle while shooting should be disposed nearby and supported to view the target area. The use of a spotting scope requires a separate support, typically a tripod or other self standing support so the spotting scope can stand alone during the shot and be quickly and easily available to the shooter after each shot. In a moving target shooting situation, the spotting scope must be redirected after each shot to provide feedback to the shooter. The spacing between the rifle and the spotting spotting scope may change as the shooting progresses and the rifle is re-aimed at the moving target. In addition, the shooter must leave the sight line aiming the gun at the target to use the spotting scope.

It is desired to provide an integrated rifle and spotting scope mount comprising a support system having a spotting scope held in spaced relation to a rifle. The tripod system must operates smoothly even with the heaviest and most expensive gear setup having separate locking and friction adjustment on each of the pan and tilt hubs. The support and integrated pan and tilt mechanisms should allow all day shooting or watching with a super heavy rifle and spotting scope with little effort to prevent user exhaustion. It is desirable that the tripod system is adapted to support the integrated rifle and spotting mount at a variety of heights to support shooting from standing, kneeling, sitting, and prone positions.

The tripod system should provides ultra-smooth movement and stable support for even the longest shots while supporting up to 50 lbs of equipment. A quick release rifle attachment such as a Picatinny cradle attachment releasably holds a rifle to the integrated rifle and spotting mount. The integrated rifle and spotting scope mount may be adapted to move the rifle and spotting scope together. The spotting scope adjustable to an orientation aligned with the rifle shot line. The integrated rifle support system may be supported by a fixed support such as a tripod or shooting fixture. The integrated rifle support system may be integrated onto common camera support devices such as a tripod having a gimbal or other movable support for moving the integrated rifle support system on vertical, horizontal and rotational axes.

BRIEF DESCRIPTION OF ONE EMBODIMENT OF THE CURRENT INVENTION

The present invention is an integrated rifle and spotting scope system featuring a tripod with a level adjustable gimbal adapted to connect to and support a frame adjustably attached to a rifle and a spotting scope. The frame comprising pan hub on the tripod, a tilt hub spaced from the pan hub, a rifle mount and a spotting scope mount on the tilt hub. The rifle on the rifle mount. The spotting scope on the spotting scope mount. The rifle and spotting scope held in fixed relation each pointed in the direction of a target. The frame adapted to hold the rifle and spotting scope in spaced relation whereby the shooter may move from sighting the rifle to peering through the spotting scope with a minimum of head movement. The shooter may adjust the eye relief of each of the rifle scope and spotting scope to minimize head movement required to switch from using one or the other while providing space to prevent interference. The present invention allows the shooter to establish a target line with the rifle aimed at the target and, by a short movement of the shooter's head, peer into the spotting scope to orient the spotting scope to a sight line generally parallel to the target line, focused generally on the target. In the event the target is moving or a different target is selected, the spotting scope moves with the rifle. The eye relief of the spotting scope and rifle scope is generally fixed. The rifle scope and spotting scope are generally aimed at the same target. The spotting scope may be disposed out of the way of the shooter while the rifle is sighted and shot. The spotting scope and rifle may be oriented independently toward the target.

The pan hub may be adapted to allow the rifle to pan in a generally horizontal back and forth manner while connected to support. The tilt hub adapted to allow the rifle to pivot in a generally vertical manner, moving the barrel of the rifle in an up and down manner. By the pan and tilt adjustment the rifle may be adjustably positioned to aim at the target. The frame may hold the rifle and spotting scope in fixed relation whereby the spotting scope may be oriented at the aiming point of the rifle and fixed in position. The integrated rifle and spotting scope mount synchronize movement of the rifle and spotting scope to move together. The rifle may be adjustably spaced from the support, and the spotting scope may be adjustably spaced from the support independent of the rifle positioning. The rifle may be adjustably spaced from the tilt hub, and the spotting scope may be adjustably spaced from the tilt hub independent of the rifle position. The eye relief of the spotting scope may be adjusted independently of the position of trifle may be adjustably spaced from the support, and the spotting scope may be adjustably spaced from the support independent of the rifle positioning The frame may be mounted on a tripod holding the rifle a predetermined height having the rifle with attached rifle scope mounted on a rifle mount and a spotting scope mounted on a scope mount. The tripod may be a 3-section, 58 inch tall Carbon Fiber tripod with 42 mm diameter top section supporting an aluminum apex. The tripod may be adapted to hold over 30 pounds and weigh approximately 6 lbs having a max height of 58 inches tall and collapses to a mere 26 inches. The unique truss construction apex may have multiple ¼-20 holes and anti-rotation pin slots for attachment to various accessories. The legs have 3 locking angle positions, 21 degree, 50 degree and 78 degree to adjust to any shooting situation using standing, sitting or prone positions. The leg locking mechanisms are accessible from front or back of the leg. Feet on the legs may have anti slip molded feet with integrated hardened stainless steel spikes. The aluminum apex may have an interchangeable flat plate/bowl releasably mounted on the frame with a spring loaded apex safety mechanism. A 75 mm bowl accessory is adapted to provide finite bubble level adjustments. The tripod adjustable to settings for prone, sitting and standing shooting positions while panning and tilting the rifle and scope in harmony keeping both generally aligned with the target.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWING

FIG. 1 is a back top perspective view of the present invention mounted on a tripod.

FIG. 2 is a front top perspective view of the present invention mounted on a tripod.

FIG. 3 is a back top perspective barrel view of the present invention mounted on a tripod.

DETAILED DESCRIPTION OF THE INVENTION

Figure 4:
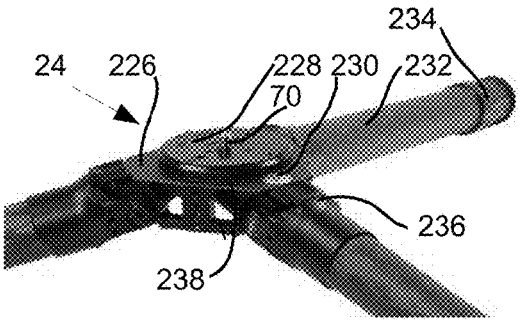
FIG. 4 is a top perspective view of a flat plate on the tripod apex of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. (It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable)

Referring to FIG. 1, the integrated rifle and spotting scope mount 10 may comprise a rifle clamp 12, a frame 14 and a spotting scope mount 16. The rifle mount 88 on the frame 14. The spotting scope mount 16 adjustably on the frame in spaced relation to the rifle mount 88. A spotting scope 18 of the type typically used for shooting sports may be mounted to the spotting scope mount 16. A long gun typically a rifle 20 may be attached to rifle mount 88. A rifle scope 22 may be fixedly attached to the rifle 12. The frame 14 may be attached to a tripod 24 or other such support as bi-pod, mono-pod, or fixed position gun mount as is used in shooting activities. tripod 24 may comprise support surface 25 pivotally attached to frame 14. Support surface 25 may further comprise a ball mount 26 disposed on support surface 25 and attached to frame 14.

Referring to FIG. 2, the integrated rifle and spotting scope mount 10 is adapted to hold the rifle 20 in a fixed position on the rifle mount 88 and the spotting scope 18 in a fixed position attached to the scope mount 16. Rifle mount 88 may comprise a rifle clamp 12 attached to frame 14 and releasably attaching rifle 20 at forestock 28 or barrel 30. The rifle 20 adapted to propel a bullet 32 along a firing line 34. The rifle scope 22 attached to the rifle 20 and adapted to provide an aim line 36 oriented with the firing line 34. The spotting scope 18 adjustably attached to the frame 14 and adapted to provide a spotting scope sight line 38 oriented generally along the firing line 34 and sight line 36. The integrated rifle and spotting scope mount 10 may be adapted to hold the rifle 20 having rifle scope 22 mounted thereon and spotting scope 18 in spaced relation. Rifle scope 22 spotting scope 18 may be adjusted to an orientation of generally in alignment with each other. The frame 14 adapted to allow the rifle 20/spotting scope 18 assembly to move in a generally vertical plane 44. The frame 14 may further comprise a tilt hub 40 and a pan hub 42. Pan hub 42 may be pivotally attached to tripod 24. The tilt hub 40 may be adapted to pivotally attach rifle 20 and spotting scope 18 to frame whereby the rifle 20 and spotting scope 18 move in a tilting up and down movement about tilt hub and generally in alignment with vertical plane 44 whereby the firing line 34, aim line 36 and sight line 38 move together maintaining a generally parallel orientation.

Referring to FIG. 3, the frame 14 may further comprise a horizontal leg 46 attached to tripod 24. Horizontal leg 46 may be attached to a vertical leg 48. Pan pivot 42 is disposed on tripod 24 and pivotally attaches to horizontal leg 46. Vertical leg 48 may be spaced from pan pivot 42. Pan pivot may rotate around axis 55 whereby aim line 36 moves in generally horizontal plane 54 having spotting scope 18 and rifle 20 moving in synchronized manner generally along horizontal plane 54. Vertical leg 48 may have a first end on horizontal leg 46 and a second end vertically spaced from horizontal leg 46. Tilt pivot 40 may be disposed on second end of vertical leg 48 in spaced relation to horizontal leg 46.

Tilt pivot 40 may further comprise tilt hub 50 adapted to pivotally attach horizontal leg 46 to L-plate 56. L-plate 56 may comprise L-plate first leg 58 and L-plate second leg 60. L-plate first leg 58 may be attached to tilt hub 50. L-plate second leg 60 may be attached to L-plate first leg 58 in spaced relation to tilt hub 50. L-plate second leg 60 having rifle mount 88 adapted to removably attach to rifle 20. L-plate 56 may pivot with respect to frame 14 about axis 52. L-plate 56 may pivot with respect to tripod 24 about axis 55.

Continuing to refer to FIG. 3, pan hub 42 may be attached to horizontal leg 46 and adjustably, pivotally attached to tripod 24. Pan hub 42 pivots about axis 56 whereby shot line 34 and aim line 36 move in a generally horizontal plane 54.

Referring to FIG. 4. the tripod 24 may comprise legs 232 hingedly connected to apex 226 by hinge 236. Bubble level 230 may be mounted on apex 226. Anti slip molded feet 234 on legs may have stainless steel spikes extending away from apex 226. Quick release 238 may be mounted in apex 226 to releasably hold mounting plate 228 on tripod 24 with threaded fastener 70 extending therefrom.

Figure 5:
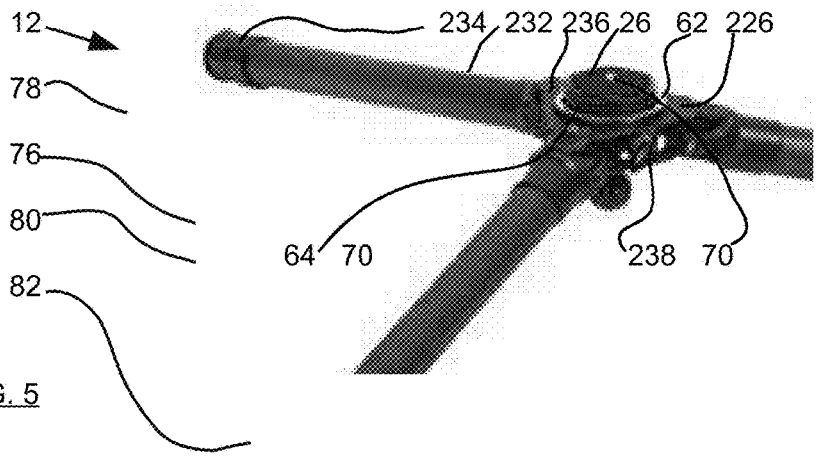
FIG. 5 is a top perspective view of a leveling bowl on the tripod apex of the present invention.

Referring to FIG. 5, ball mount 26 may comprise a tripod interface 62 surroundingly supporting partial spherical gimbal 64. Gimbal 64 may further comprise a threaded shaft 70. Quick release 238 may be mounted in apex 226 to releasably hold gimbal 64 on tripod 24.

Figure 6:
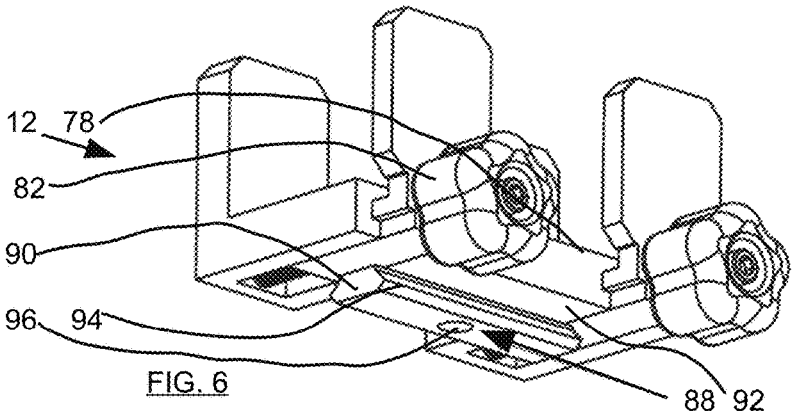
FIG. 6 is a bottom perspective view of the rifle clamp of FIG. 5.

Referring to FIG. 6, rifle clamp 12 may further comprise a base 76 having fixed tabs 78 fixedly attached thereto and adjustable tabs 80 adjustably attached to base 78 using threaded fasteners 82. Rifle clamp 12 may further comprise a NATO type rail 90 disposed on base bottom 92. Rail 90 may have a cross section of a dovetail tenon adapted to attach to second leg 60.

Figure 7:
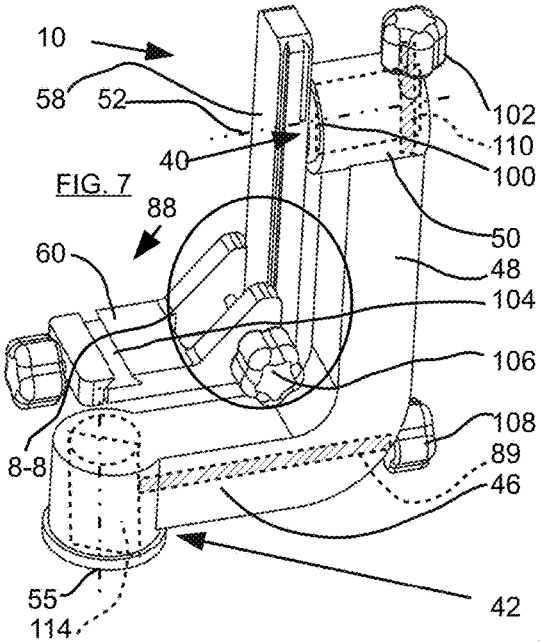
FIG. 7 is a top front perspective view of the present invention.

Referring to FIG. 7, the integrated rifle and spotting scope mount 10 may comprise horizontal bearing assembly 100 in tilt hub 50. Horizontal bearing assembly 100 on vertical leg 48 may be pivotally attached to L-plate first leg 58. Tilt stop 102 may be on tilt hub 50 to interface with horizontal bearing 100 by way of shaft 110 adapted to bear against horizontal bearing 100 and prevent tilt movement of first leg 58 locking first leg 58 in a predetermined position. L-plate second leg 60 may be held in a perpendicular relation to L-plate first leg 58 by L-plate pivotal connector 106. Rifle mount 88 may comprise a connector 104 such as a dovetail mortise adapted to receive rail 90 (FIG. 6). Pan stop 108 may have shaft 89 adapted to adjustably bear against pan bearing 114 to hold frame in a predetermined position.

Figure 8:
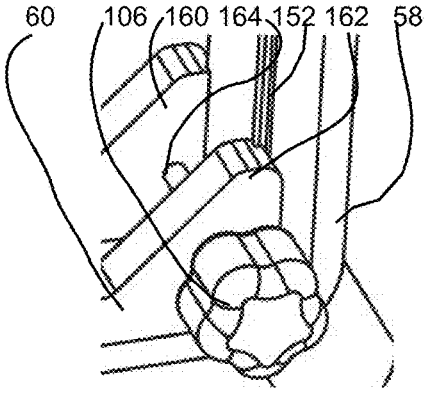
FIG. 8 is a detail taken at approximately 8-8 of FIG. 7.

Referring to FIG. 8, second leg 60 is adjustably attached to first leg 58 by tabs 160, 162 engaging slots 152 on first leg 58. threaded fastener 106 is adapted to threadably engage tab 160 and bear against tab 162 urging the tabs 160, 162 to clamp onto first leg 58. Second leg 60 may be repositioned along first leg 58 by loosening threaded fastener 106 and sliding second leg 60 along first leg 58 to a predetermined position where threaded fastener urges tabs 160, 162 to clamp onto first leg 58.

Figure 9:
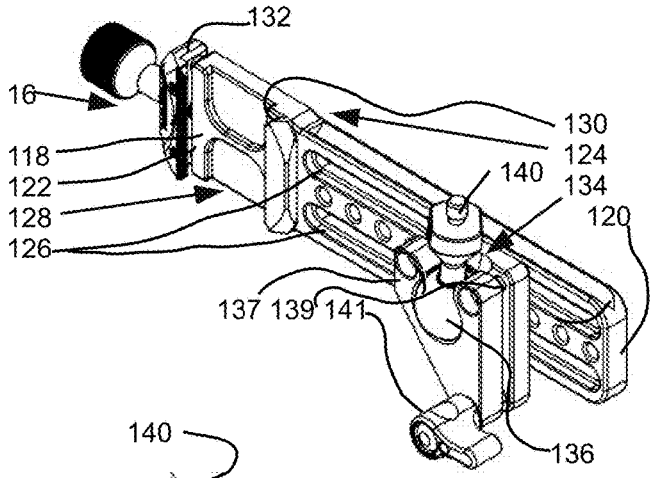
FIG. 9 is a top front perspective view of the scope mount of present invention.
Figure 10:
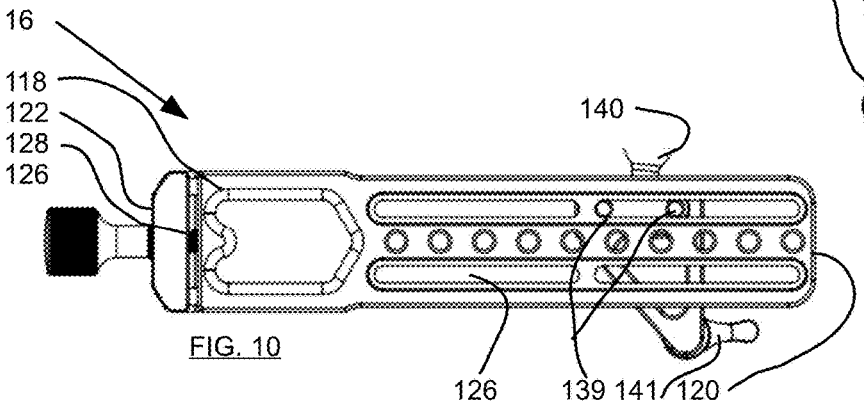
FIG. 10 is a front plan view of the scope mount of present invention.

Referring to FIGS. 9 and 10, scope mount 16 may comprise of scope bar 118 having a first end 120 and second end 122. L-plate clamp 124 may be a screw operated clamping device disposed on second end 122. Eye relief slots 126 may be formed in scope bar 118 from a position adjacent second end to L-plate clamp 124. L-plate clamp 124 may comprise a dovetail fixture 128 having a fixed angular slot 130 formed in scope bar 118 and a movable jaw 132 adjustably attached to second end 122. Scope clamp 134 may be adjustably mounted along eye relief slot 126. Scope clamp 134 may comprise a fixed base 135 and a clamp plate 137. Fixed base 135 is attached to scope bar 118. Clamp plate 137 is removably attached to fixed base 135 by threaded fasteners 139 and wing nut 141. Scope clamp 134 may comprise a pivot-able ball 136 held between fixed base 135 and wing nut 141. Loosening wing nut 141 may allow pivotable ball to move to a predetermined orientation having threaded scope rod 140 extending outward from scope bar 118.

Figure 11:
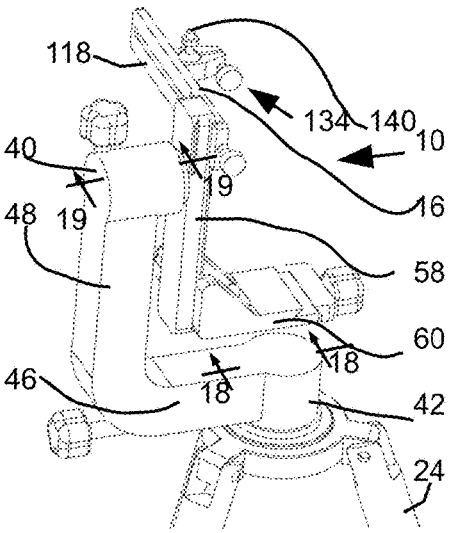
FIG. 11 is a perspective view of the present invention with the scope bar attached.
Figure 12:
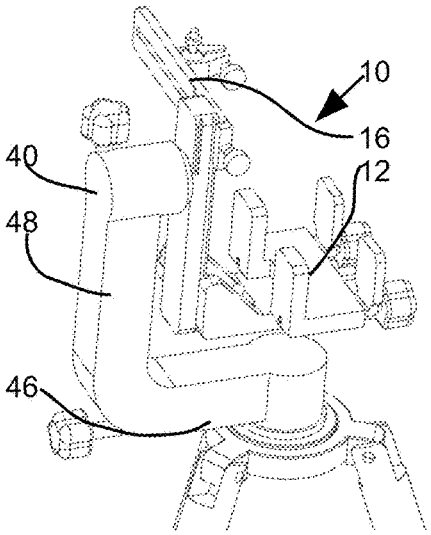
FIG. 12 is a perspective view of the present invention of FIG. 11 with the rifle clamp attached.

Referring to FIGS. 11 and 12, the integrated rifle and spotting scope mount 10 may comprise a L-plate 56 pivotally mounted on frame 14. Frame 14 pivotally mounted on tripod 24. L-plate 56 adapted to releasably attach to scope mount 16 and rifle mount 88. The height and position of the scope mount is adjustable vertically as well as fore and aft along first leg 56 and scope mount bar 118. The ball mount 134 will allow pivot and orientation of scope shaft 140

Figure 13:
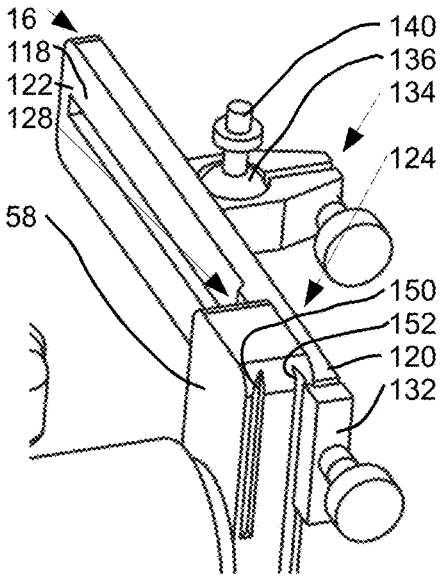
FIG. 13 is a perspective view of the scope bar attachment of FIG. 12.

Referring to FIG. 13, scope mount 16 may be adjustably attached to L-plate 56 at first leg 58 by clamp 124. First leg 58 may comprise slots 150, 152 formed on opposing sides of vertical leg 48 for adjustable attachment to scope bar 118. Slots 152 are formed between slots 150 and vertical leg 48 and are adapted to receive jaws 130, 132. Fixed jaw 130 may be disposed in slot 150 or 152 with adjustable jaw 132 in opposing slot. Scope clamp 134 may be disposed along bar 118 between first end 120 and second end 122.

Figure 14:
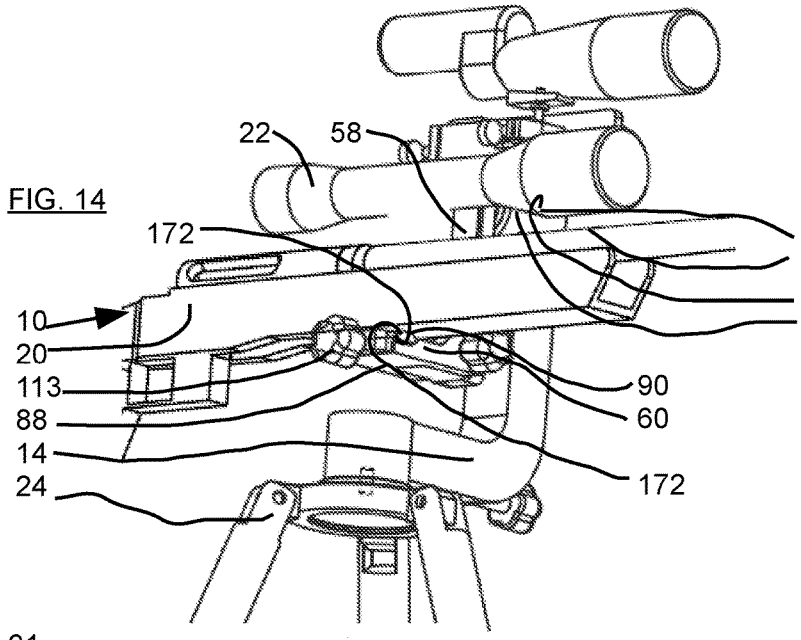
FIG. 14 is a bottom perspective view of the rifle mount of the present invention.

Referring to FIG. 14, rail 90 may be mounted directly on rifle 20. Rail 90 may have angular side 172 adapted to bear against angular surface 170 on rifle mount 88 forming a dovetail type mortise and tenon. Clamp 113 may be tightened to removably hold rifle 20 on second leg 60.

Figure 15:
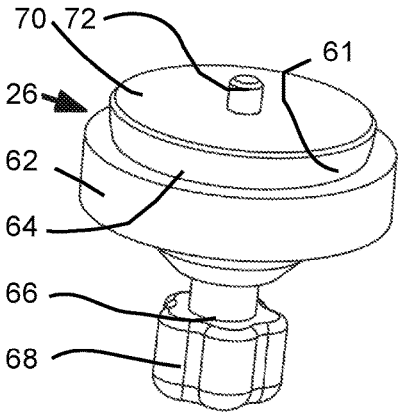
FIG. 15 is a top perspective view of the leveling bowl removed from the tripod of the present invention.
Figure 16:
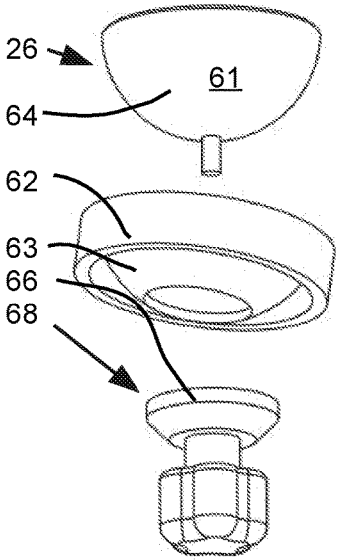
FIG. 16 is a bottom perspective exploded view of the leveling bowl removed from the tripod of the present invention.
Figure 17:
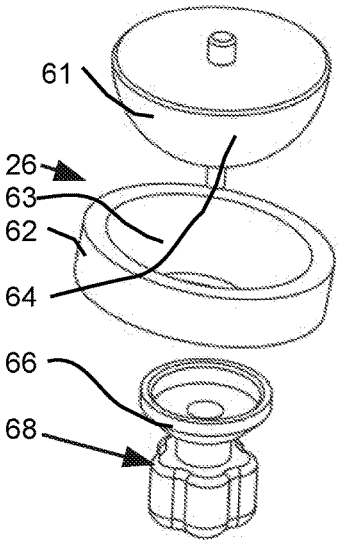
FIG. 17 is a top perspective exploded view of the leveling bowl removed from the tripod of the present invention.

Referring to FIG. 15-17, ball mount 26 may comprise gimbal 64 having a semi spherical shaped bottom 61 set in apex interface 62. Gimbal further comprises a threaded shaft 70 extending from frame surface 72. Apex interface 62 may have a semi spherical shaped bowl 63 adapted to receive bottom 61 therein. Bowl 63 may comprise opening 65 adapted to receive gimbal shaft 69 whereby gimbal 64 may rotationally move having bottom 61 in bowl 63 with shaft 69 in opening 65. Gimbal rotation stop 68 further comprises collar 66 adapted to bear against outside of bowl 63 adjacent opening 65. Gimbal rotation stop 68 is adapted to engage gimbal shaft 69 and traverse along shaft 69 to urge collar 66 to bear against outside of bowl 63. Gimbal rotation stop 68 threadably engages gimbal shaft 69 to urge gimbal 64 to compress into bowl 63 thereby forcing gimbal 64 to bear against inside of bowl 63 increasing friction between gimbal 64 and bowl 63 to fix gimbal 64 in an angular orientation with respect to apex interface 62.

Figure 18:
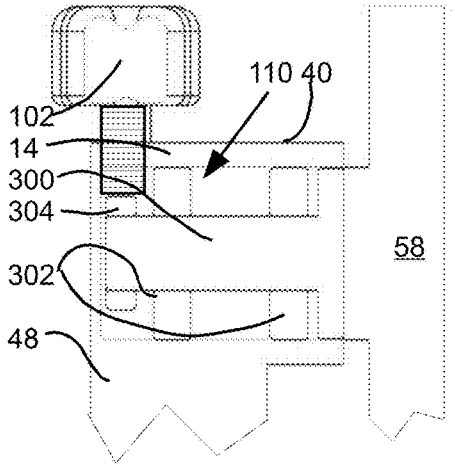
FIG. 18 is a section view of the tilt hub taken at approximately 18-18 of FIG. 11.

Referring to FIG. 18, Tilt hub 40 further comprises bearing assembly 110 having tilt stop 102 adapted to threadably traverse in tilt hub 40 by turning extending knob to cause shaft to threadably traverse in tilt hub 40 to bear against friction ring 304 on pivot shaft 300 between bearings 302. Pivot shaft 300 is adapted to pivotally attach to first leg 58 to tilt hub 40.

Figure 19:
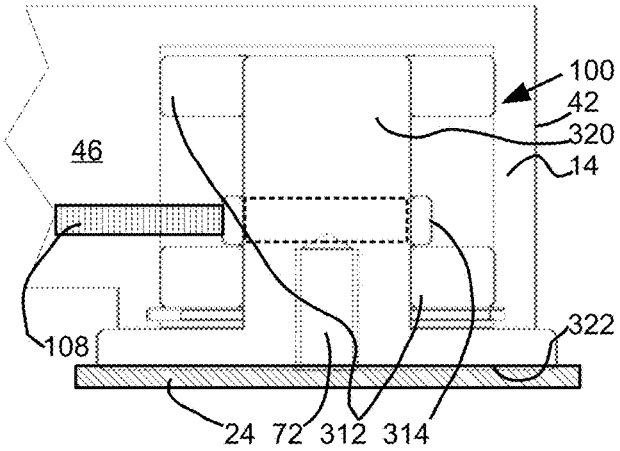
FIG. 19 is a section view of the tilt hub taken at approximately 19-19 of FIG. 11.

Referring to FIG. 19, pan hub 42 further comprises bearing assembly 100 having pan stop 108 adapted to threadably traverse in horizontal leg 46 to engage and bear against friction ring 314 on hub 320. Horizontal leg 46 is attached to bearings 312. Bearings 312 are on hub 320. Horizontal leg 46 pivots about hub 320 having bearings 312 there between. Friction ring 314 may be disposed between bearings 312 on hub 320. Pan stop 108 bears against friction ring 314 to increase or decrease friction between friction ring and hub 320 to urge horizontal leg 46 to maintain a rotational orientation about hub 320. reversing the threadable traverse of pan stop 108 reduces friction between friction ring 314 and hub 320 requiring less force to pivot horizontal leg 48 in a generally horizontal plane about hub 320. Hub 320 may be attached to tripod 24 by shaft 72. Hub 320 may further have a base 322 on tripod 24.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. An integrated rifle and spotting scope mount for mounting a rifle and a spotting scope on a support, the support comprising a support surface, the integrated rifle and spotting scope mount comprising:

a frame, the frame comprising a rifle mount, a spotting scope mount, pan hub and a tilt hub, the pan hub pivotally on the support, the tilt hub pivotally attached to the pan hub, the rifle mount on the tilt hub, the spotting scope mount on the tilt hub, the rifle mount in spaced relation to the spotting scope mount, wherein the support comprises a tripod, the tripod further comprising an apex, a ball mount on the apex, the ball mount attached to the frame.

2. The integrated rifle and spotting scope mount of claim 1, wherein the apex further comprises a level adjustment.

3. The integrated rifle and spotting scope mount of claim 1, wherein the ball mount comprises a gimbal.

4. The integrated rifle and spotting scope mount of claim 1, further comprising an eye relief, the ball mount on the eye relief, the scope mount on the ball mount.

5. The integrated rifle and spotting scope mount of claim 4, wherein the eye relief further comprises a scope bar, the scope bar comprising a fixed base, the fixed base on the frame, the ball mount adjustably fixed to the scope bar.

6. The integrated rifle and spotting scope mount of claim 1, wherein the frame further comprises a horizontal leg, the pan hub on the horizontal leg, the tilt hub on the horizontal leg, the tilt hub spaced from the pan hub.

7. The integrated rifle and spotting scope mount of claim 1, wherein the frame further comprises a vertical leg, the vertical leg on the pan hub, the tilt hub on the vertical leg, the pan hub spaced from the tilt hub.

8. The integrated rifle and spotting scope mount of claim 7, wherein the frame further comprises a horizontal leg, the pan hub on the horizontal leg, the vertical leg on the horizontal leg, the vertical leg spaced from the pan hub.

9. The integrated rifle and spotting scope mount of claim 8, further comprising an L-plate, the L-plate comprising a first leg and a second leg, the first leg on the tilt hub, the second leg attached to the first leg, the rifle mount on the L-Plate.

10. The integrated rifle and spotting scope mount of claim 8, wherein the horizontal leg further comprises a pan end and a second end, the pan hub adjacent the pan end, the vertical leg further comprises a first end and a tilt end, the first end on the horizontal leg, the tilt hub adjacent the tilt end.

11. The integrated rifle and spotting scope mount of claim 10, wherein the pan hub is on the pan end, the second end on the first end, the tilt hub on the tilt end.

12. The integrated rifle and spotting scope mount of claim 8, further comprising an L-plate, the L-plate comprising a first leg and a second leg, the tilt hub further comprising a tilt shaft and a tilt bearing, the tilt bearing comprising an outside race on the tilt hub, an inside race on the tilt shaft, the tilt shaft on the first leg, the scope mount on the first leg, the rifle mount on the second leg.

13. The integrated rifle and spotting scope mount of claim 8, further comprising a shaft on the ball mount, the scope mount on the shaft.

14. An integrated rifle and spotting scope mount on a tripod, the tripod comprising an apex, the integrated rifle and spotting scope mount comprising:

a frame, the frame comprising a horizontal leg, a vertical leg, a pan hub and a tilt hub, the pan hub on the apex, the horizontal leg on the pan hub, the vertical leg on the horizontal leg, the vertical leg spaced from the pan hub, the tilt hub on the vertical leg, the tilt hub spaced from the horizontal leg;

a rifle mount on the tilt hub; and a scope mount on the tilt hub, the scope mount spaced from the rifle mount.

15. The integrated rifle and spotting scope mount of claim 14, further comprising an L-plate, the L-plate comprising a first leg and a second leg, the L-plate on the tilt hub, the first leg on the second leg, the first leg generally perpendicular to the second leg, the rifle mount on the first leg, the scope mount on the second leg.

16. The integrated rifle and spotting scope mount of claim 15, wherein the pan bearing further comprises a pan bearing, the tilt hub further comprises a tilt bearing, the pan bearing on the apex, the pan bearing attached to the horizontal leg whereby the horizontal leg pans about the apex in a generally horizontal plane, the tilt bearing in the tilt hub, the tilt bearing attached to the L-plate.

17. An integrated rifle and spotting scope mount comprising a tripod having an apex with a leveling adjustment, a rifle with an attached rifle scope and a spotting scope, the integrated rifle and spotting scope mount further comprising:

a frame, the frame having a horizontal leg and a vertical leg, the vertical leg on the horizontal leg;

a pan hub, the pan hub comprising a pan bearing, a pan stop and a pan friction ring, the pan hub on the apex, the pan bearing having an inside race on the pan hub, the friction ring on the pan hub, the pan stop adapted to releasably bear against the pan friction ring, the pan bearing having an outside race on the horizontal leg whereby the horizontal leg pivots about the pan hub in a generally horizontal plane, the vertical leg spaced from the pan hub;

a tilt hub, the tilt hub comprising a tilt shaft, a tilt bearing, a tilt stop and a tilt friction ring, the tilt hub on the vertical leg, the tilt hub spaced from the horizontal leg, the tilt bearing having an outside race on the tilt hub, an inside race surroundingly on the tilt shaft, the tilt friction ring on the tilt shaft, the tilt stop adjustably in the tilt hub, the tilt stop adapted to releasably bear against the tilt friction ring;

an L-plate, the L-plate having a first leg and a second leg, the first leg attached to the tilt shaft, the second leg adjustably attached to the first leg;

a spotting scope mount adjustably on the first leg, the spotting scope mount spaced from the second leg, the spotting scope mount comprising an eye relief slot, a first leg clamp and a ball mount, the ball mount adjustably in the eye relief slot, the spotting scope on the ball mount; and a rifle mount on the second leg, the rifle on the rifle mount whereby the rifle and spotting scope are oriented at a target, the rifle and spotting scope pivot together about the pan hub and pivot together about the tilt hub.

* * * * *